United States Patent [19]

Oka et al.

[11] 4,396,275

[45] Aug. 2, 1983

[54] TONER IMAGE TRANSFER TYPE ELECTROGRAPHIC COPYING MACHINE

[75] Inventors: Tateki Oka, Toyohashi; Kenichi Wada, Sakai, both of Japan

[73] Assignee: Minolta Camera Kabushiki Kaisha, Osaka, Japan

[21] Appl. No.: 262,430

[22] Filed: May 11, 1981

[30] Foreign Application Priority Data

May 14, 1980 [JP] Japan ..... 55-64246
Mar. 24, 1981 [JP] Japan ..... 56-43579

[51] Int. Cl.[3] ..... G03G 15/00

[52] U.S. Cl. ..... 355/14 R; 355/3 BE; 355/16

[58] Field of Search ..... 355/3 BE, 16, 14 R, 355/3 R, 11, 8, 15

[56] References Cited

U.S. PATENT DOCUMENTS 3,976,375 8/1976 Kurita et al. ..... 355/16 X
4,025,180 5/1977 Kurita et al. ..... 355/16 X

*Primary Examiner*—R. L. Moses
*Attorney, Agent, or Firm*—Watson, Cole, Grindle & Watson

[57] ABSTRACT

A toner image transfer type electrographic copying apparatus is disclosed which comprises an endless image carrier, at least two support rollers around which the endless image carrier is wrapped, a drive motor and clutch for rotating one of the support rollers, a control device for controlling the operation of the clutch, a lamp and lens mechanism for forming an electrostatic latent image on the surface of a unit length portion of the endless image carrier, a device for developing the electrostatic latent image on the surface of the endless image carrier so as to change it into a toner image, a device for transferring the toner image onto the surface of a transfer paper sheet, and a device for removing residual toner on the image carrier. The toner-removing device is disposed adjacent to the image-developing device. A length m times (m is an integral number equal to at least 3) as long as a unit length is fixed as the overall circumferential length of the image carrier, and the image carrier is rotated by the drive motor by a unit drive distance at least n times (n is smaller than m and is an integral number greater than 1 and is a number which has no common factor with m other than 1) as long as the unit length for each copying operation.

10 Claims, 9 Drawing Figures

TONER IMAGE TRANSFER TYPE ELECTROGRAPHIC COPYING MACHINE

BACKGROUND OF THE INVENTION

This invention relates to a toner image transfer type electrographic copying apparatus designed to develope an electrostatic image carried on the surface of an electrostatic latent image carrier to change the image into a toner image and to transfer the toner image onto the surface of a sheet of copy paper.

In an electrographic copying apparatus of the type described, it is well known to provide the electrostatic latent image carrier, which may be, for example, a photosensitive member having a photoconductive layer on its surface, in the form of a belt A as shown in FIG. 1. The belt A or photosensitive body is stretched between two support rollers B and C, and means such as a charger D, an original image-illustrating lamp E, a SELFOC lens F, a developing device G, a transfer device H, a cleaning device 1*a*, a charge erasing lamp J, are provided around the belt A adjacent to the outer circumferential surface of the belt. With the start of a copying operation, as shown in FIG. 1, an image exposing unit integrally holding the charger D, the lamp E and the SELFOC lens F (a lens array formed by arranging light-transmitting optical fibers in a plurality of lines) is moved above a flat first image surface stretch $a_1$ of the belt A positioned in an opposed relation with respect to an original K in the direction indicated by arrow P in FIG. 1. An electrostatic latent image corresponding to the original K is formed on the first surface stretch $a_1$ by the unit travelling in the manner described. Thereafter, the belt A is rotated by rotation of support roller B and C in the direction M in the figure and the latent image formed on the first image surface stretch $a_1$ is developed by a developing device G to provide a toner image. The toner image is thereafter transferred by the transfer device H onto the surface of a copy paper sheet N. Simultaneously therewith, as shown in FIG. 1, a second flat image surface stretch $a_2$ on that side which is not opposed to the original K is moved to a position on the side opposing the original K between the support rollers B and C after the residual toner and charge have been removed from the stretch $a_2$ by a cleaning device I and a charger erasing lamp J. When it is desired to make a plurality of copies in sequence, namely to obtain several copies sequentially from one original, the described copying step is repeated while an electrostatic latent image is sequentially formed on the first and second image surface stretches $a_1$ and $a_2$.

In the structure described, the developing device G and cleaning device I are positioned a large distance apart, i.e., so as to oppose each of curved portions a' and a'' of belt A as shown in FIG. 1. Accordingly, when it is desired to reuse the toner collected by the cleaning device I to develop a latent image, the toner must be transferred by hand from the cleaning device I to the developing device G or a suitable automatic transfer mechanism utilized. The use of an automatic transfer mechanism, however, makes the copying apparatus large in size and complicated. To position the developing device G near the cleaning device I in an attempt to improve this situation, it is necessary to move the photosensitive belt A at least one rotation and a half for every copying operation, which reduces the copying speed particularly when continuous copying is desired.

On the other hand, in the structure described, image exposure is effected with respect to the flat first and second image surface stretches of the photosensitive belt. Accordingly, the structure described has the advantage that it not only produces no such distortion of an image as is seen in the exposure of the curved image surface of the circumference of a cylinder, but it also enables full-frame image exposure other than slit image exposure by use of the SELFOC lens. However, when the belt A is stopped, parts of the photosensitive belt corresponding to curved portions a' and a'' formed along the outer circumference of each of the support rollers B and C between the image surface stretches $a_1$ and $a_2$ are wasted, i.e., the portions are not used for forming an electrostatic latent image. In addition thereto, the support rollers B and C have to be larger than a certain value in diameter from the viewpoint of the strength of curvature of the photosensitive belt A, which, in turn, results in an increase also in the length of the curved portions a' and a'' over a certain length, with the result that the structure described makes it necessary to reduce the percentage of effective length the belt A.

SUMMARY OF THE INVENTION

An object of the present invention is to provide a toner image transfer type electrographic copying apparatus which facilitates supply and reuse of collected toner uses an endless electrostatic latent image carrier in such a way that it is possible to make substantial use of approximately the entire circumferential stretch of the carrier for forming an electrostatic latent image, and which provides for high-speed copying.

Another object of the invention is to provide a toner transfer type electrographic copying apparatus which can prevent complication and enlargement in the mechanism for feeding the toner to a developing means by disposing the cleaning means close to the developing means, and in addition thereto, a toner transfer type electrographic copying apparatus which substantially includes no part of the electrostatic latent image carrier left unused for forming an electrostatic latent image, and hence a toner image transfer type electrographic copying apparatus which can be produced at low cost.

Another object of the invention is to provide a toner image transfer type electrographic copying apparatus in which the amount of rotation of the endless electrostatic latent image carrier which is required for copying one sheet of copy paper is less than one rotation, and in which effective use of the entire circumferential stretch of the carrier and high speed copying are made possible.

The basic characteristic of the invention lies in the fact that a length corresponding to a length equal to or slightly longer than the length of a unit image surface stretch in the direction of the stretch being driven is fixed as a unit length l and an endless electrostatic latent image carrier having a circumferential length m times (m represents 3 or an integral number greater than 3) as long as the unit length is used and the carrier is rotated, in principle, n times as long as the unit length l (n is smaller than m and an integral number greater than 1 and has no common with m other than 1) for copying each sheet of copy paper.

Another basic characteristic of the invention lies in the fact that a transferring means for transferring the toner image onto the surface of a sheet of copying paper is disposed between a means for forming an electrostatic image on the surface of the carrier and a means for removing the residual toner on the surface of the carrier in the direction of the carrier being moved. Stated more particularly, an endless electrostatic latent image carrier, in which a unit image surface to be used for forming an electrostatic latent image of a maximum image size (a maximum image size corresponds to a maximum copying size in an equimultiple copying machine) is arranged in one row composed of m number of surface structure, is m times as long as the unit length l which is equal in overall length to or a little longer than the length of the unit image surface stretch. The electrostatic latent image carrier is rotated n/m (less than one revolution) for one sheet of copy paper. Thus, different unit image surface stretches are fed onto an exposure position in regular sequence for every n/m revolution and the initial unit image surface stretch is again fed onto the exposure position when the copying operation has come to copying m number of sheets of copy paper. During the time, m number of unit image surface stretches are all for once subjected to electrostatic latent image forming operation. Each unit image surface stretch goes through such procedures in which, after the surface stretch has an electrostatic latent image formed thereon by an electrostatic latent image forming means, the image is changed into a toner image, the toner image is transferred by a transfer means onto a sheet of copy paper, and the residual toner on the carrier is removed by a cleaning means. The process in this conjunction from the change of a latent image into a toner image to the transfer of the toner image onto copy paper should be carried out when the latent image carrier is rotated during copying. On the other hand, removal of the residual toner needs not be carried out immediately after transfer of the toner image, and it is only necessary to remove the toner at any suitable time prior to the unit image surface stretch being used for subsequent copying. Accordingly, the cleaning means may suitably be positioned in any place, and hence it may be disposed adjacent to a developing means.

These and other objects and characteristics of the invention will become more apparent from a description given thereof in conjunction with the accompanying drawings showing preferred embodiments of the invention.

DETAILED DESCRIPTION OF THE PREFERRED EMBODIMENTS

Figure 1:
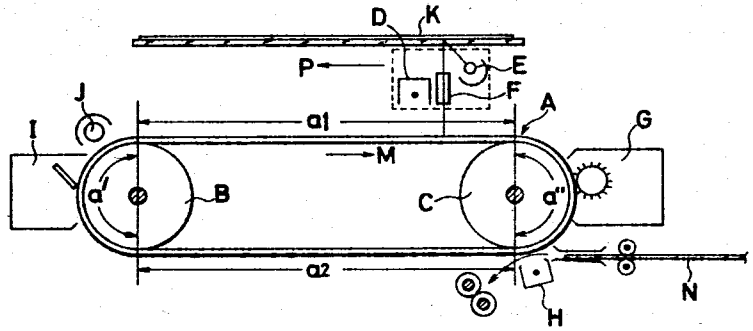
FIG. 1 is a side elevation of the essential part of a prior art copying apparatus.
Figure 2:
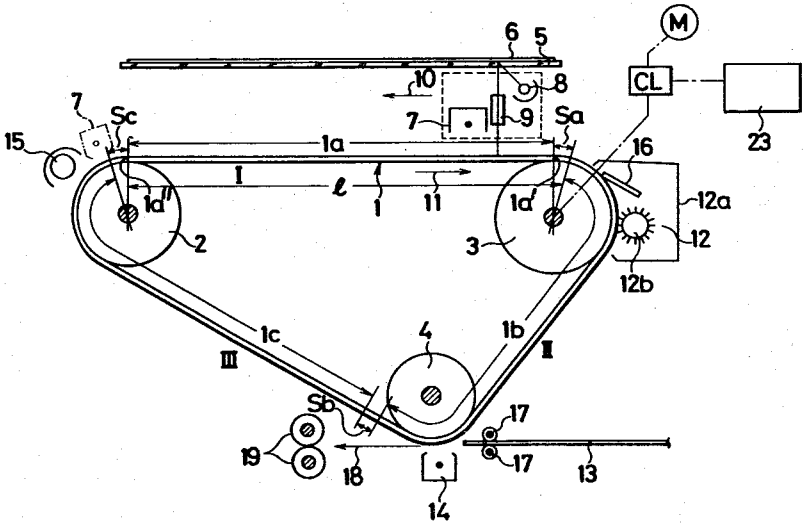
FIG. 2 is a side elevation showing the essential part of a preferred embodiment of the toner image transfer type electrographic copying apparatus of the present invention.

Referring now to the drawings and particularly to the embodiment shown in FIG. 2, numeral 1 designates an endless electrographic photosensitive belt having a photoconductive layer thereon. The belt 1 is stretched between three support rollers 2, 3 and 4. The belt 1 forms first, second and third unit image surface stretches 1*a*, 1*b* and 1*c*, all equal in length, the surface stretches being separated by respective safety spaces S*a*, S*b* and S*c* in the direction of belt movement as indicated by arrow 11. Each of the unit image surface stretches 1*a*, 1*b* and 1*c* is separately used for each copying operation during which an electrostatic latent image is formed on a copy paper sheet. When the surface stretch 1*a* is placed in an exposure position I between the support rollers 2 and 3, the stretch is brought into a flat plane which extends in parallel with a stand 5 and is positioned in an opposed relation with respect to an original sheet 6 on the stand 5. Incidentally, the size of each of the unit image surface stretches corresponds to a maximum size of the electrostatic image, which size is equal to a maximum copying size in this embodiment. When an image exposure unit integrally holding a charger 7, an illuminating lamp 8, and SELFOC lens 9 moves in the direction indicated by arrow 10, each corresponding unit stretch is electrically charged and subjected to image-forming exposure such that an electrostatic latent image is formed thereon which corresponds to the image of the original 6.

The photosensitive belt 1, after the belt has thus been subjected to an image-forming exposure, is driven in the direction indicated by arrow 11 by the support rollers 2, 3 and 4 which are driven by a drive control means whose operation is controlled by a drive control curcuit 23, such that the belt 1 will move in synchronism with the start of the return movement of the image exposure unit in the direction opposite to the direction indicated by arrow 10. With this movement, each surface stretch passes through various treatment steps, including development of the electrostatic latent image formed on each of the unit image surface stretches 1*a*, 1*b* and 1*c*. More specifically, these treatment steps include changing the latent image into a toner image, transferring the toner image onto the surface of the copy paper sheet 13, erasing of charge from the image surface stretches 1*a*, 1*b* and 1*c* after the transfer of the toner image onto the copy paper sheet, and cleaning of the residual toner on the surface stretches.

The support rollers 2, 4 are driven at the same peripheral speed as that at which the support roller 3 is driven by a main motor M via a clutch CL, the clutch being controlled by the drive control circuit 23. After a print switch has been turned on, namely after an electrostatic latent image is formed on the surface of the photosensitive belt, the clutch CL is engaged by the drive control circuit 23 in accordance with the start of the copying operation and thus acts to transmit the drive power of the main motor M to the support roller 3. Disengagement of the clutch CL is also effected by the drive control circuit 23 in a correctly timed relation through a mechanism to be presently disclosed in FIG. 5.

In the state in FIG. 2 in which the first unit image stretch 1*a* is shown brought to the exposure position I, the support roller 4 is placed so as to be at the front end of the surface stretch 1b in the direction indicated by arrow 11 in which the roller 4 moved the photosensitive belt 1 in charge of the second unit image surface stretch 1b, and a developing means 12 for changing the electrostatic latent image formed by image exposure on each of the unit image surface stretches 1a, 1b and 1c into a toner image is positioned adjacent to the rear end of the second unit image surface stretch 1b in an opposed relation with respect to the support roller 3. A transfer means 14 for transferring the toner image onto a copy paper sheet 13 is positioned at the front end of the second unit image surface stretch 1b and is opposed to the support roller 4, and a charge erasing lamp 15 for erasing charge prior to removing the residual toner from the unit image surface stretches 1a, 1b and 1c after the toner image has been transferred is positioned adjacent to the front end of the third unit image surface stretch 1c. A cleaning device 16 for removing the residual toner from the unit stretches 1a, 1b and 1c after completion of the erasing of charge is positioned within the developing device 12 to thereby operate on the rearward end side of the photosensitive belt 1 at the point of action of the device 12 on the second unit image surface stretch 1b so as to operate on the rear end side of the second unit image 1b behind the point of action of the device 12 on the photosensitive belt 1, namely so as to operate on this side of the surface stretch 1b in the direction of the belt 1 being driven.

Figure 4:
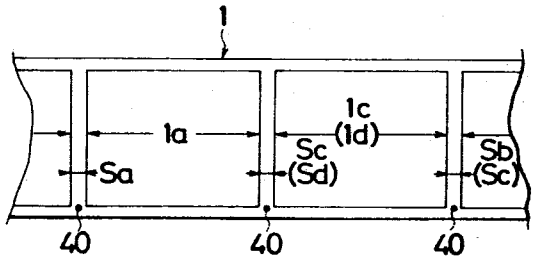
FIGS. 4 and 5 are segmentary views showing, respectively, preferred embodiments of position control mechanisms for the photosensitive belt in the inventive apparatus.

The photosensitive belt 1 is designed to be of such a length that the overall circumferential length L of the belt 1 is three times as long as the unit length l, which corresponds to the total length of the length of one unit image surface stretch 1a, 1b or 1c (a longitudinal length of each unit image surface stretch in this embodiment see FIG. 4) plus the length of one safety space S*a*, S*b* or S*c* in the direction of the belt being driven. Thus the overall circumferential length L is a little over three times as long as the length of one unit image surface stretch 1a, 1b or 1c. In contrast thereto, the apparatus is designed to finish one cycle of copying by moving the photosensitive belt 1 a length twice as long as the unit length l, this device length being called a unit drive distance Lo.

The cleaning device 16, which is disposed in the casing 12a common to the developing device 12, comprises a cleaning blade in slidable contact with the surfae of the photosensitive belt 1 and it is designed to be positioned upwardly of a developing sleeve 12b. In the figure, numeral 17 designates rollers for transferring the copy paper sheet 13 onto a transferring station and 19 designates a fixing device for not only receiving the copy paper sheet 13 fed from the transferring station in the direction indicated by arrow 18 but also for fixing the transferred toner image to the surface of the sheet 13.

The drive control circuit 23 is intended not only to control the amount of movement of the belt 1 for every copying operation but also to prevent an ill effect produced by the fact that, when a copying operation is not carried out over an extended period of time, the surface of the photosensitive belt 1 is left charged or the toner is left attached to the surface of the belt 1. Namely, the drive control circuit 23 is so designed that when a timer detects that a copying operation has not been carried out over a specified period of time, the circuit 23 alone produces a copying operation after having stabilized the property of the photosensitive member of the belt 1. Stated more concretely, in the above case, pressing of a print switch starts no copying operation but rotates the belt 1 to move it an integral number of times as long as the unit length l of the belt 1. On the other hand, the drive control unit 23 may be so designed as to rotate the belt 1 to move it an integral number of times as long as the unit length l of the belt 1 irrespective of a copying operation after completion of copying or completion of the final copying in continuous copying operation. However, in the embodiment illustrated in FIG. 2, such a rotation of the belt 1 is unnecessary, the reason being that, since in the embodiment illustrated in FIG. 2 a contrived charging and image exposure system is employed, there is no danger that the surface of the belt 1 will be left charged. On the other hand, when a charger 7 is disposed in the position shown by a phantom line in FIG. 2 and also when a full-frame exposure system to be later described (FIGS. 3 and 8) is employed, the above noted rotation of the belt 1 by the drive control circuit 23 is utilized. Although the drive control circuit 23 is not shown in the embodiments in FIGS. 8 and 9, they also include circuits equal to the circuit 23.

Referring now to the sequence of copy operations, pressing of a print switch (not shown) starts copying operation such that the image exposure unit moves in the direction indicated by arrow 10, and a first unit image surface stretch 1a in the exposure position I is charged and exposed to light to thereby form on the unit image surface stretch an electrostatic latent image corresponding to the image of the orignal 6 on the unit image surface stretch 1a. After completion of the image exposure, the exposure unit starts to move in a direction opposite to that indicated by arrow 10 (so as to return to its initial position). Simultaneously therewith, the photosensitive belt 1, by means of support rollers 2, 3, and 4, which are controlled by the drive control circuit 23, is driven a unit drive distance Lo, namely by an amount of 2 l's in the arrow-indicated direction 11. By so doing, the first unit image surface stretch 1a is moved through a second position II in which the second unit image surface stretch 1b was previously positioned between the support rollers 3 and 4 to a third position III in which the subsequent third unit image surface stretch 1c was previously positioned. During this movement the developing device 12 begins operating immediately before the entering end 1a' of the first unit image surface stretch 1a reaches it, and when the first unit stretch 1a passes through the developing device 12, a toner is attached to the electrostatic latent image carried on the stretch 1a to thereby change the image into a toner image. A cleaning device 16 disposed on this side of the developing device 12 acts on the first unit stretch 1a prior to the developing device 12 to thereby clean the surface of the stretch 1a, but since a blade constituting the device 16 is formed of an insulating material such as a synthetic resin, there is no possibility of the electrostatic latent image being spoiled by the blade before the image is developed.

When the trailing end 1a'' of the first unit stretch 1a passes through the developing device 12, the device 12 stops functioning immediately. On the other hand, just before the entering end 1a' of the first unit stretch 1a reaches the transfer device 14, a voltage is applied to the device 14 and a copy paper sheet 13 is transported by feed rollers 17 onto a transferring station in synchronism with movement of the first unit stretch 1a to thereby transfer the toner image on the first unit stretch 1a onto the copy paper sheet 13. After the copy paper sheet 13, which has the toner image transferred thereon by the transfer device 14, is separated from the belt 1, the paper is fed to a fixing device 19 as shown by arrow 18, and has the toner image fixed thereto as it passes through the device 19. After the trailing end 1*a*" of the first unit stretch 1*a* has passed by the transfer device 14, the application of voltage to the transfer device 14 and the driving of the feed rollers 17 are stopped and the belt 1 is also stopped after the first unit stretch 1*a* has reached the third position III, thus substantially bringing to and end a first cycle of a copying operation. Incidentally, prior to the end of the copying operation, the entering end portion of the first unit stretch 1*a* reaches the position of charge erasing lamp 15 and charge is erased from this entering end portion.

At the point in time when the first copying cycle is completed, the second unit image surface stretch 1*b*, which is located ahead (in the direction of belt movement) of the first unit image surface stretch 1*a*, is positioned in the exposure position I between the support rollers 2 and 3, and this second unit stretch 1*b* passes through the same copying steps in a subsequent copying cycle as the first unit stretch 1*a*. The second unit stretch 1*b*, after having been charged and exposed in the exposure position I, passes through developing and transfer steps and reaches the third position III and so as complete a second copying operation. Simultaneously therewith, a third unit stretch 1*c*, which is ahead of the second unit stretch 1*b*, is positioned in the exposure position I in preparation for a third copying cycle. On the other hand, the first unit image surface stretch 1*a*, during the second copying cycle using the second unit stretch 1*b*, passes through the charge erasing lamp 15 where the charge still remaining on the first unit stretch 1*a* is erased by the lamp 15, this lamp being lit during the time from after the charging of the belt 1 and exposure of the image on the belt till the stopping of the belt 1 by completion of copying. When the stretch 1*a* moves from the exposure position I to the next second position II, the greater part of the stretch 1*b*, except for the trailing end portion thereof, passes through the charging device 16 and, upon removal of the residual toner, waits in the second position II. After the residual toner is removed during the third copying operation using the third stretch 1*c*, the stretch 1*a* is brought again to the exposure position I and is used in the fourth copying operation.

In this connection, the first stretch 1*a* completes charging, image exposure, development and transfer during the first copying, cycle completes charge erasing during a second copying cycle, and completes cleaning and final charge erasing during a third copying cycle. By the three copying cycles described above, the copying step of the first unit image surface stretch 1*a* is completed. Also, the second unit image surface stretch 1*b* completes cleaning and final erasing during the preceding first copying cycle of the first stretch 1*a*, completes charging, image exposure, development, and transfer during the second copying cycle, and completes charge erasing during the third copying cycle. The copying step of the second unit image surface stretch 1*b* is also completed by the three copying cycles noted above.

The third unit image surface stretch 1*c* completes charge erasing during the preceding first copying cycle, completes cleaning and final charge erasing during the preceding second copying cycle, and completes charging, image exposure, development, and transfer during the third copying cycle. The treatment steps on the third unit image surface stretch 1*c* also are completed by the three copying cycles. As is apparent from the description so far given, three copying cycles in the embodiment shown are completed by three copying operations. Accordingly, the three copying cycles are each substantially completed by one copying operation, namely by movement of one unit drive distance Lo of the photosensitive belt 1. Because the steps of charging and image exposure, development and transfer, and the step of charge erasing and the step of cleaning and final charge erasing are simultaneously accomplished with respect to each of the unit image surface stretches 1*a*, 1*b* and 1*c*.

The table 1 below shows the position of each unit image surface stretch 1*a*, 1*b* and 1*c* at the start of each copying operation.

TABLE 1

| | Copying | | | |
|---|---|---|---|---|
| Position | First cycle | Second cycle | Third cycle | Fourth cycle |
| Exposure position I | 1a | 1b | 1c | 1a |
| Second position II | 1b | 1c | 1a | 1b |
| Third position III | 1c | 1a | 1b | 1c |

Referring now to the relationship between the overall circumferential length L of the photosensitive belt 1, the unit drive distance Lo and the unit length l in the embodiment in FIG. 2, a multiplication factor m of the overall circumferential length L with respect to the unit length l is 3 and a multiplication factor n of the unit drive distance Lo with respect to the unit length l is 2. Namely, the factor n=2 of the unit drive distance Lo with respect to the factor m=3 of the overall length L becomes an integral number having no common factor other than 1. All the unit image surface stretches 1*a*, 1*b* and 1*c* may be cyclical in the exposure position I without fail by making the factor n with respect to the factor m an integral number having no common factor other than 1 and, moreover because of the unit drive distance Lo being an integral number, the stretches 1*a*, 1*b* and 1*c* are fixed in the specified positions I, II and II when the photosensitive belt is stopped. The factor n is 2 and the factor m is 3 in the embodiment illustrated, to which fundamentally the relationship between m and n is not restricted. Namely, in order to make effective use of the overall circumference of the photosensitive belt 1, if, in the relationship between the unit drive distance Lo=nl controlled by the drive control circuit 23, and the overall circumferential length L of belt 1=ml, n is an integral number greater than 1 and moreover has no common factor other than 1 with respect to m, a combination of various values is possible. Such combination is shown in Table 2 below.

TABLE 2

| Multiplication factor (m) | Multiplication factor (n) |
|---|---|
| 3 | 2 |
| 4 | 3 |
| 5 | 2, 3, 4 |
| 6 | 5 |
| 7 | 2, 3, 4, 5, 6 |

In table 2 above, when n is smaller in value, the unit drive distance Lo becomes shortened and becomes favorable. Accordingly, if m is set as an odd number and n=2, the distance of rotation of belt 1 in copying one copy paper sheet becomes the smallest and accordingly the copying speed in continuous copying can be increased to a maximum.

Incidentally, during a copying operation each of the safety spaces Sa, Sb and Sc serves to prevent, for example, charge and image exposure for the first unit stretch 1*a* in the exposure position I from producing an undesirable effect on the portions of the stretch adjacent to the second and third unit stretches 1*b* and 1*c*, the charge erasing lamp 15 from producing effects on the end of the electrostatic latent image formed on the first unit stretch 1*a*, to thereby produce blurred or blackened image end portions and other troubles. Furthermore, the presence of the spaces Sa, Sb and Sc provides the advantage with which the seamed portion of the belt 1 can be located in the spaces. However, in principle, there is no necessity of forming such safety spaces. The photosensitive belt 1 in the embodiment in FIG. 2 permits the overall length L of the belt to be just three times as long as the length of one unit image surface stretch 1*a*, 1*b* or 1*c* in the drive direction of the belt 1. Also, the position of the transfer device 14, and more particularly the transfer position of a toner image, must be disposed in the position in which the unit stretch subjected to copying during a copying operation is permitted to pass through the transfer position in consideration of the fact that the copy paper sheet on which the toner image is to be transferred during copying operation must be discharged from the copying apparatus. Namely, the transfer position must be positioned in such a position in which the distance from the position, in which the rear end portion of the unit image surface stretch to be subjected to copying is positioned in time of starting of copying, in the direction of the belt being driven along the surface of the belt is shorter than the unit drive distance Lo. Also, since all that is necessary for the developing device 12 to do is to develop the elctrostatic latent image by the point of time of transfer, it is possible to dispose the device 12 in any position between the exposure position I and the transfer position in which the transfer device 14 is provided. The cleaning device 16 is disposed within the developing device 12 and the residual toner removed from the surface from the belt 1 is collected directly into the developing device 12 and put into reuse. The cleaning device 16, if it is disposed adjacent to the developing device 12 even outside the device 12, can very easily feed the removed and collected residual toner directly to the device 12 without requiring a great amount of labor or any other complicated automatic conveying means. Even if such means should be required, simple guide plate or the like would sufficiently serve the purpose.

Furthermore, the cleaning device 16 need not be disposed on this side of the developing means 12 in the direction of the belt 1 being driven with respect to the belt 1 but may be disposed rearwardly of the device 12 in the direction indicated by arrow 11. However, for bringing about a necessary cleaning effect in the above case, the blade of the cleaning device must be brought into contact with the surface of the photosensitive belt 1 only during passage of the unit image surface stretch which is subjected to cleaning or only during the inoperative state of the device 12. The cleaning device 16 is disposed slightly backward of the trailing end of the unit image surface stretch in the second position II and the charge erasing lamp 15 is disposed slightly backward of the entering end of the unit stretch in the third position III. The cleaning device 16, when the belt 1 stops, has not completed cleaning of the unit image surface stretch which stops in the second position II and which is adapted to be cleaned, but finishes cleaning that remaining portion of the unit stretch at the initial time when the belt 1 was driven again in the next copying cycle. The developing device 12 operates after the unit stretch of belt 1 which was to be cleaned has passed and just before the next unit stretch of belt 1 passes which is to be subjected to development after image exposure. The charge erasing lamp 15 is lit simultaneously with starting of the driving of the belt 1, and is intended to erase charge on the unit stretch positioned in the third position III without the front portion of the unit stretch. But when the unit stretch which is subjected to charge erasing reaches the third position III and stops there after it has finished the preceding copying, the charge erasing lamp 15, which is lit during movement of the belt 1, has already erased charge on that front portion of the belt 1 which has passed through the lamp 15 during the preceding copying, with the result that midway erasing does not matter. Accordingly, the cleaning device 16 may be disposed together with the developing device 12 in any position between the exposure position I and the transfer position in which the transfer device 14 is disposed, and the erasing lamp 15 may be disposed in any position opposite to the third position III.

Image exposure in the exposure position can be effected by fixing a charger 7, an illuminating lamp 8, and SELFOC lens 9 in position and by moving an original 6 and the belt 1 synchronously and, in addition thereto, by use of the full-frame exposure system. In the case of the full-frame exposure system, the charger 7 must be disposed on this side of the exposure position I as shown by a phantom line in FIG. 2, and it is necessary to charge in advance the entire area of the unit stretch which reached the position I for exposure therein, and it is necessary to turn off a charger 7 at least during passage of the unit stretch which is to be cleaned.

Figure 3:
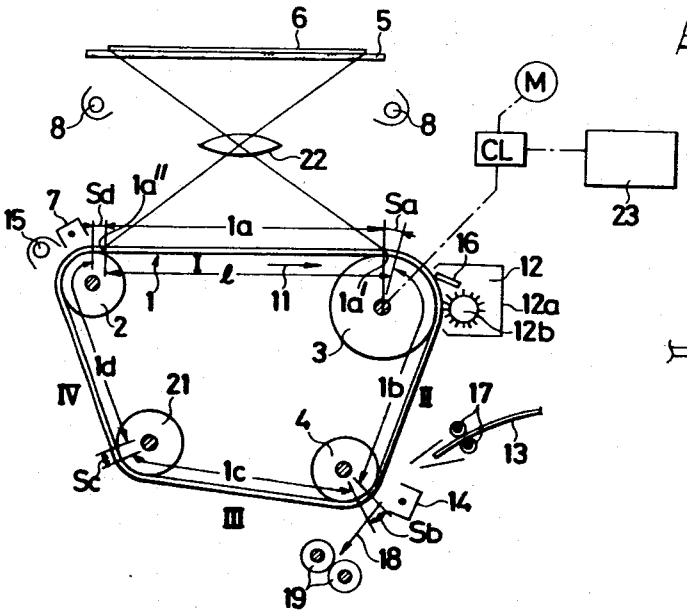
FIG. 3 is a side elevation showing the essential part of another embodiment of the toner image transfer type electrographic copying apparatus of the present invention.

The copying apparatus illustrated in FIG. 3 is an apparatus in which the overall circumferential length L of the photosensitive belt 1 is four times as long as the unit length l, namely it has a multiplication factor m=4 in Table 2, and in which the unit drive length Lo is three times as long as the unit length l, namely it has a multiplication factor n=3. The members and elements used in the apparatus in this embodiment are indicated by the same reference characters as the members and elements of the apparatus shown in FIG. 2. The same is applicable to other embodiments to be presently described.

The photosensitive belt 1 is stretched between four support rollers 2, 3, 4 and 21 and first, second, third and fourth unit image surface stretches 1*a*, 1*b*, 1*c* and 1*d*, four in all and equal in length, are continued through uniform safety spaces of certain width Sa, Sb, Sc and Sd in the direction of belt 1 indicated by arrow 11 (see FIG. 4). In the embodiment a full-frame exposure system is employed by the combined use of lamps 8 for illuminating an original 6 and an ordinary lens 22 capable of full-frame image projection, and a charger 7 is disposed outside of the exposure position I, namely an electrostatic latent image forming position. In this case, image exposure with respect to each of the unit image surface stretches 1*a*–1*d* is effected with the belt 1 being stopped. In the state in FIG. 3, image exposure is effected on the first unit image surface stretch 1*a* to form on the surface of the photosensitive belt 1 an electrostatic latent image corresponding to the image of an original 6.

The belt 1, after the image exposure, is driven in the direction indicated by arrow 11 by the support rollers 2, 3, 4 and 21 which are controlled by drive control circuit 23 which is a drive control means. In driving of the belt 1, treatment steps are carried out which include development of the electrostatic latent image formed on each unit image surface stretch 1*a*, 1*b*, 1*c* and 1*d* in the exposure position I, namely, change of the latent image into a toner image, transfer of the toner image onto the surface of a copy paper sheet 13, erasing of charge on each unit stretch 1*a*, 1*b*, 1*c* and 1*d*, and removing the residual toner on the surface stretch. The support rollers 2, 4, 21 are driven at the same peripheral speed synchronized with the support roller 3 which is driven and controlled by the drive control circuit 23, but the drive control of the roller 3 is made by the drive control circuit 23 and the mechanism to be described later and illustrated in FIG. 5.

In the state in FIG. 3 in which the first unit stretch 1*a* is positioned in the image exposure position, the roller 4 is disposed in the position to which the entering end of the second unit stretch 1*b* in the direction of the belt 1 driven and the safety space Sb come. The developing device 12 for changing the electrostatic latent image formed by exposure on each unit stretch 1*a*, 1*b*, 1*c* and 1*d* into a toner image is disposed adjacent to the trailing end of the second unit stretch 1*b* in an opposed relation with respect to the roller 3. The transfer device 14 for transferring the toner image onto the copy paper sheet 13 is disposed at the entering end of the second unit stretch 1*b* in an opposed relation with the support roller 4. The charge erasing lamp 15 for erasing charge on each unit stretch 1*a*, 1*b*, 1*c* and 1*d* after transfer of the toner image before removing redisual toner on each of the stretches is disposed adjacent to the entering end portion of the fourth unit stretch 1*d*. The cleaning device 16 for cleaning each unit image surface stretch 1*a*, 1*b*, 1*c* and 1*d* after erasing of charge is disposed within the developing device 12 and is intended to operate on that trailing end side of the second unit stretch 1*b* which is backward of the point of action of the device 12 on the exposure belt 1, namely on this side of the belt 1 in the direction of belt 1 driven.

The photosensitive belt 1 is designed to be of such a length that the overall circumferential length L of the belt 1 is four times as long as the unit length l corresponding to the total length of the length of one unit image surface stretch 1*a*, 1*b*, 1*c* or 1*d* (a longitudinal length of each unit image surface stretch in this embodiment-see FIG. 4) plus the length of one safety space Sa, Sb, Sc and Sd in the direction of the belt being driven, namely a little over four times as long as the length of one unit image surface stretch 1*a*, 1*b*, 1*c* or 1*d*. In contrast thereto, the apparatus is designed to finish one cycle of copying step by moving the photosensitive belt 1 a length three times as long as the unit length l, fixed as a unit drive distance Lo.

Referring now to operation, pressing of a print switch (not shown) starts the copying operation to thereby expose the first unit image surface stretch 1*a* already charged by the charger 7 and positioned in the exposure position I to form on the unit image surface stretch 1*a* an electrostatic latent image corresponding to an image of the original 6. After completion of the image exposure, the photosensitive belt 1 is driven in an arrow-indicated direction 11 an amount equal to the unit drive distance Lo, namely to the amount of 3 l by the support rollers 2, 3, 4 and 21 controlled by the drive control circuit 23. By this, the unit image surface stretch 1*a* carrying the latent image formed on the surface is moved to a fourth position IV through a second position II in which a second unit image surface stretch 1*b* is initially positioned between the support rollers 3 and 4 and through a third position III in which a third unit image surface stretch 1*c* is initially positioned. During this movement, the developing device 12 starts operation just before the entering end 1*a*′ of the first unit image surface stretch 1*a* reaches the device 12, and the first image surface stretch 1*a* passes through the developing device 12. At this time, a toner is attached to the electrostatic latent image carried on the first unit image surface stretch 1*a* to thereby change the image into a toner image. A cleaning device 16 positioned within the developing device 12 acts on the first unit image surface stretch 1*a* prior to the device 12 to thereby clean the surface stretch 1*a*. However, since a blade constituting the device 16 is formed of an insulating material such as a synthetic resin, there is no possibility of the electrostatic image being spoiled by the blade before the image is developed.

When the trailing end 1*a*″ of the first unit surface stretch 1*a* passes through the developing device 12, the device 12 stops functioning immediately. On the other hand, just before the entering end 1*a*′ of the first unit stretch 1*a* reaches a transfer device 14, a voltage is applied to the device 14. Simultaneously therewith, a copying paper sheet 13 is transported by feed rollers 17 to a copying transferring station in synchronism with movement of the first unit stretch 1*a* to thereby transfer the toner image on the first unit stretch 1*a* onto a copy paper sheet 13. The copy paper sheet 13 having been transferred the toner image thereon through the transfer device 14 is separated from the belt 1 and is thereafter fed to a fixing device 19 in an arrow-indicated direction 18 and has the toner image fixed thereto by the paper being passed through the device 19. After the trailing end 1*a*″ of the first unit stretch 1*a* has passed through the transfer device 14, application of voltage to the transfer device 14 is stopped. At the point in time at which the first unit stretch 1*a* has reached the fourth position IV, the belt is also stopped, thus substantially bring to an end a first cycle of the copying operation. Incidentally, prior to the end of the copying operation, the entering end portion of the first unit stretch 1*a* has reached the position of charge erasing lamp 15 and charge has been erased from the entering portion.

At the point in time when the first copying operation is completed, a second unit image stretch 1*b* charged by the charger 7 comes to the exposure position I between the support rollers 2 and 3 and is positioned there and in the subsequent copying cycle this second unit stretch 1*b* passes through the same step of copying as the first unit stretch 1*a*. The second unit stretch 1*b*, after having been exposed in the exposure position I, passes through developing and transfer steps and reaches a fourth position IV and completes a second copying operation. Simultaneously therewith, a third unit stretch 1*c* ahead of the second unit stretch 1*b* is positioned in the exposure position I in preparation for a third copying operation. The first unit stretch 1*a* passes through the charge erasing lamp 15 during the second copying by the second unit stretch 1*b*. Namely, the charge remaining on the first unit stretch 1*a* is erased by the lamp 15 being lit during the time from starting of driving after the exposure of the image on the belt 1 till stopping of the belt 1 by completion of copying. When the stretch 1*a* comes from the fourth position IV to the next third position III in a second copying operation, it passes a cleaning device 16 and the residual toner thereon is removed. It stops in the third position III.

In this connection, the first unit stretch 1*a*, in the second copying operation, passes through the charge erasing and cleaning steps and completes the copying step. Simultaneously therewith, since image exposure, development, and transfer with respect to the second unit stretch 1*b* in the second copying operation are carried the copying operation and all the treatment steps necessary for copying are, after all, completed by mere movement of the belt 1 to the amount of one unit drive distance Lo in one cycle of copying, namely to the amount of 3 l. In other words, though the entire copying step with respect to one unit image surface stretch, each step of image exposure, development, and transfer, each step of charge erasing and cleaning, step of final charge erasing, and step of charging are carried out at different time between the present copying time and the subsequent copying time, etc, so that driving the belt 1 to the amount of one unit drive distance Lo for one cycle of copying is sufficient.

At the point in time when the second copying operation is complete, a third unit stretch 1*c* is positioned in the exposure position I and at the point in time when the third copying operation is complete, a fourth unit stretch 1*d* comes to the exposure position I. At this point in time, a first unit stretch 1*a* is positioned in the second position II, a second unit stretch 1*b* is positioned in the third position III, and the third unit stretch 1*c* is positioned in the fourth position IV. The completion of the fourth copying ends in one use cycle of each of unit stretch 1*a*, 1*b*, 1*c* and 1*d*, and again the first unit stretch 1*a* comes to the exposure position I. The above cycle use is repeated thereafter. Table 3 below shows position of each unit stretch 1*a*, 1*b*, 1*c* and 1*d* in its position at each cycle of copying.

TABLE 3

| | Copying | | | | |
|---|---|---|---|---|---|
| Position | First cycle | Second cycle | Third cycle | Fourth cycle | Fifth cycle |
| Exposure position (I) | 1a | 1b | 1c | 1d | 1a |
| Second position (II) | 1b | 1c | 1d | 1a | 1b |
| Third position (III) | 1c | 1d | 1a | 1b | 1c |
| Fourth position (IV) | 1d | 1a | 1b | 1c | 1d |

Figure 5:
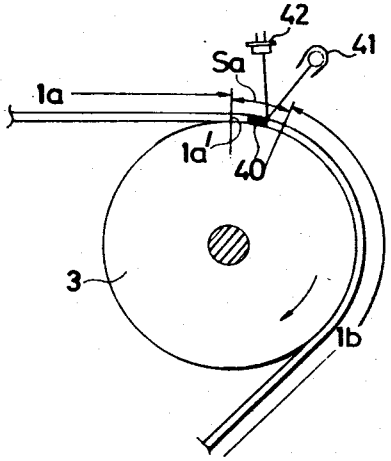

FIGS. 4 and 5 show a mechanism for controlling the position of the electrosensitive belt 1 in the embodiments in FIGS. 2 and 3. The same is, of course, applicable to the FIGS. 8 and 9 embodiments. As shown in FIG. 4, a position detecting mark 40 is provided in the position of each safety space Sa, Sb, Sc, (Sd). As shown in FIG. 5, the mark 40 is detected by a light source 41 and a photosensitive element 42 in the manner that driving of the support roller 3 is instantly stopped by inputting a detection signal from the element 42 into the drive control circuit 23. The position detection mark 40 may be replaced by a hole provided in the photosensitive belt 1. The light source 41 and photosensitive element 42 are disposed in an opposed relation with respect to the support roller 3 but may be disposed in another position in which the position detection mark 40 should be detected.

Figure 6:
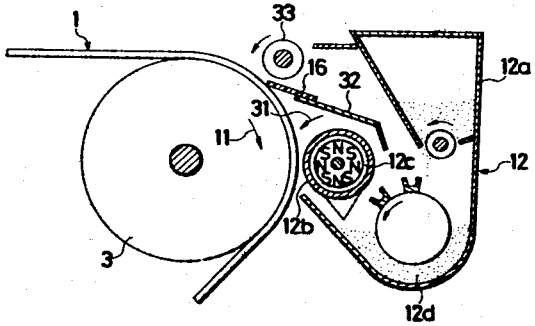
FIG. 6 is a sectional view showing an embodiment of the developing device and cleaning device used in the present invention.
Figure 7:
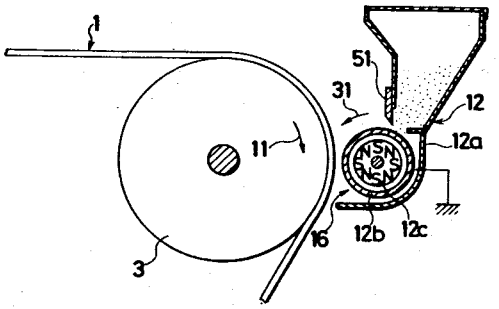
FIG. 7 is a sectional view showing another embodiment of the developing device and cleaning device.

FIGS. 6 and 7 show, respectively, embodiments of cleaning and developing devices. FIG. 6 shows the magnetic brush devices used in the FIGS. 2 and 3 embodiments, wherein the developing device 12 uses a two-component magnetic developer. The device 12 feeds the developer in the direction indicated by an arrow 31 by rotation of a magnetic roller 12*c* and/or a developing sleeve 12*b* outside of the roller 12*c*. By so doing, when the unit stretch, an object of development, on which the electrostatic latent image is formed passes, a toner is electrostatically attracted to the latent image on the unit surface stretch to change the image into a toner image. Stopping of the developing device 12 is effected by stopping the rotation of the magnetic roller 12*c* and/or the developing sleeve 12*b* to thereby discontinue feed of the developer. A cleaning blade as a cleaning device 16, because it is made of synthetic resin such as polyurethane and is insulative, serves the purpose as described earlier. As far as it is disposed on backward side of the position of action of the developing device 12 in the direction of the belt being driven, it may be always in its active state. In the figure, the blade is shown fixed to the front end of a toner guide plate 32 disposed fixedly within the casing 12*a*.

On the top of the cleaning device 16 is provided a toner collecting roller 33 for feeding the residual toner removed by the device 16 from that unit stretch which is an object of cleaning to the guide plate 32 side. The guide plate 32 guides the toner to a developer store position 12*d* of the casing 12*a* for putting the thus toner into reuse.

FIG. 7 shows an example of the case in which the magnetic brush developing device 12 uses a one-component magnetic developer consisting of magnetic toner. The developing sleeve 12*b* is earthed and designed to transport or feed a magnetic toner in the direction indicated by an arrow 31 and to develop the electrostatic latent image while causing the sleeve 12*b* to attract the toner to its circumference like a brush in cooperation with a magnetic roller 12*c*.

On the other hand, charge on the unit image surface stretch to be cleaned has been erased by the charge erasing lamp as previously described by the time that the unit stretch passes through the cleaning position, and the unit stretch as already lost the attractive power to electrostatically attract a toner thereto. Accordingly, when the unit stretch passes the sleeve 12*b*, the residual toner on the unit stretch is removed from the stretch by the toner being magnetically attracted to the surface of the sleeve 12*b*, and the magnetic brush developing device 12 functions also as a cleaning device 16. In this case, the developing device 12 is caused to operate for developing and cleaning during the copying operation when both the unit stretch to be developed after image exposure and the unit stretch which is to be cleaned and which was subjected to copying in preceding time pass. Accordingly, when the two unit stretches pass alternatingly and continuously, the developing device 12 may be caused to operate continuously, and when the two unit stretches pass discontinuously, the device 12 may be operated discontinuously in timed relation with respect to the discontinuous passage. In the figure, the numeral 51 designates a limiting plate for limiting an amount of magnetic toner to be attracted like a brush onto the circumference of the sleeve 12*b*.

Figure 8:
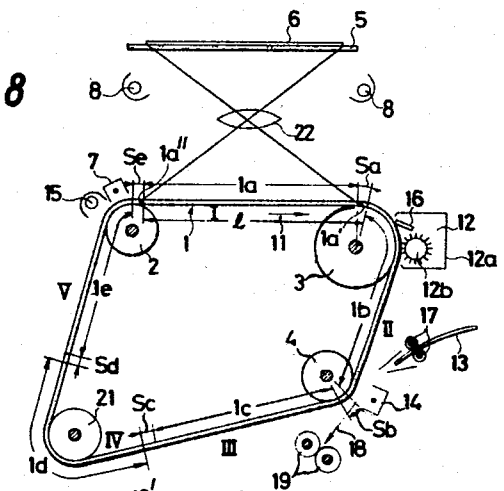
FIGS. 8 and 9 are side elevations showing, respectively, the essential parts of other embodiments of the invention.

An embodiment shown in FIG. 8 is of the construction in which the overall circumferential length L of the photosensitive belt 1 is five times as long as the unit length l, namely multiplication factor m=5, the unit drive distance Lo is twice as long as the unit length l, namely multiplication factor n=2.

The cleaning device 16, developing device 12 and transfer device 14 are disposed in the second position II in which the second unit stretch 1*b* next to the first unit image stretch 1*a* that was positioned in the exposure position I is positioned, and the charge-erasing lamp 15 is disposed in the fifth position V in which the fifth unit stretch 1*e* on backward side of the first unit image surface stretch 1*a* is positioned. In exposing the image, a full-frame exposure system is employed by use of lamps 8 for illuminating a original 6 and an ordinary lens 22 capable of full-frame image projection, and a charger 7 is disposed out of the exposure position I.

In this case, exposure of image onto each unit stretch 1*a*–1*e* is effected with the belt 1 being stopped, and after exposure of an image is effected onto the first unit stretch 1*a* in the state shown in FIG. 8, the belt 1 is driven in the direction indicated by arrow 11, stops when the first unit stretch 1*a* reaches the third position III, and thus substantially completes one cycle of copying operation. At this time, the fourth unit stretch 1*d* which was positioned in the fourth position IV comes to the exposure position I and is subjected to a second cycle of the copying operation. When the second copying operation is effected, the preceding first unit stretch 1*a* reaches the fifth position V and charge is erased from the entering end portion of the stretch 1*a* by the charge erasing lamp 15, and the second unit stretch 1*b* is positioned in the exposure position I. Along with the movement of the belt 1 which is made when a third cycle of copying is carried out, erasing of charge is effected with respect to the remaining portion of the first unit stretch 1*a*. Thereafter, the first unit stretch 1*a* passes through the cleaning device 16 and reaches the second position II and a greater part of the stretch 1*a* is cleaned.

When the third copying cycle ends, the fifth unit stretch 1*e* comes to the exposure position I and when a fourth cycle of copying is effected by the unit stretch 1*e*, the remaining portion of the first unit stretch 1*a* has been cleaned. Thereafter, when the third unit stretch 1*c* positioned in the exposure position I is subjected to fifth copying, the stretch 1*a* positioned in the fourth positive IV, is charged by the charger 7 and reaches the exposure position I and waits for a sixth cycle of copying to thereby bring the first unit stretch 1*a* again into a ready-for-copying state. Table 4 indicates each unit stretch 1*a*, 1*b*, 1*c*, 1*d* and 1*e* in its position at each cycle of copying.

TABLE 4

| Position | Copying | | | | | |
|---|---|---|---|---|---|---|
| | First cycle | Second cycle | Third cycle | Fourth cycle | Fifth cycle | Sixth cycle |
| Exposure position (I) | 1a | 1d | 1b | 1e | 1c | 1a |
| Second positon (II) | 1b | 1e | 1c | 1a | 1d | 1b |
| Third position (III) | 1c | 1a | 1d | 1b | 1e | 1c |
| Fourth position (IV) | 1d | 1b | 1e | 1c | 1a | 1d |
| Fifth position (V) | 1e | 1c | 1a | 1d | 1b | 1e |

The developing device 12, transfer device 14, charge erasing lamp 15, cleaning device 16, and feed rollers 17 are the same in operation timing as the preceding embodiments. The charger 7 charges only the unit stretch which reaches the exposure position I and which is to be subjected to subsequent exposure, and operate only in time of passage of the unit stretch that is to be subjected to charging. Incidentally, when copying is achieved by using a length four times as long as the unit length l of the belt 1 as a unit drive distance Lo, it may also be possible to make a unit stretch to be subjected to each cycle of copying take the entirely the same turn as the preceding embodiments like the first, second, third . . . arranged in the arrow-indicated direction 11 in which the belt 1 is driven. But the unit drive distance Lo necessary for one copy cycle is increased, with the result that copying speed is reduced in comparison with the preceding embodiments.

Figure 9:
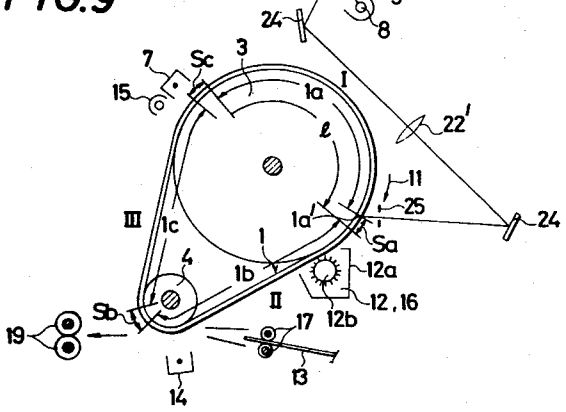

The embodiment shown in FIG. 9 shows an example of a copying apparatus of the type in which the belt 1, while being moved, is subjected to slit image exposure. This embodiment is also the same in principle as the embodiments described so far. In the embodiment, the overall circumferential length L of the belt 1 is three times as long as the unit length l, namely, a multiplication factor m=3, and the unit drive distance Lo is twice as long as the unit length l, namely, a multiplication factor n=2.

An original stand 5 and the photosensitive belt 1 are synchronously moved, and light from the original illuminating lamp 8 is reflected by the image surface of the original 6 on the moving stand 5 sequentially from the front end of the moving original. Reflecting light passes through projection lens 22' suitable for the slit image exposure, is reflected by a suitable reflecting mirror 24, and is thereafter projected on the belt 1 through a slit 25 to carry out slit exposure.

When a print switch is turned on in the state shown in FIG. 9, the stand 5 and the belt 1 are moved synchronously at equal speed in the direction indicated by arrows 10' and 11. The first unit stretch 1*a* is successively exposed from the entering end 1*a'* and reaches the third position III and stops there and completes a first cycle of copying. During this time, in the second position II, the electrostatic image on the belt 1 is changed into a toner image by a developing device 12, and is transferred onto a copy paper sheet 13 by a transfer device 14. On the other hand, at the point in time when the first cycle of copying is ended, the second unit stretch 1*b* that was in the second position II comes to the exposure position I. When a second cycle of copying is carried out, the first unit stretch 1*a* has completed charge erasing at 15, and reaches the second position II and stops there in the state of most of the unit stretch having been cleaned by a cleaning device 16. When a third cycle of copying is effected, the unit stretch 1*a* that was in the second position II is charged by the charger 7 after having been cleaned and again reaches the exposure position I and stops there.

When the slit exposure system is employed as in the case of this embodiment, there is no necessity of providing the photosensitive belt 1 with a flat portion, with the result that the photosensitive belt 1 may be replaced by a photosensitive drum. Also, the charger 7 may be positioned with respect to the slit 25 immediately backward in the direction of the belt being driven. However, in this case, the stopping position of the photosensitive belt 1 must be the position in which the entering end of each unit stretch comes directly below the charger 7. By so doing, charging of the surface of the belt 1 is effected immediately before image exposure, and accordingly there is no possibility of the surface of the photosensitive belt being left charged. Table 5 below shows each unit stretch 1*a*, 1*b*, 1*c* in its position at each cycle of copying.

TABLE 5

| Position | Copying | | | |
|---|---|---|---|---|
| | First cycle | Second cycle | Third cycle | Fourth cycle |
| Exposure position (I) | 1a | 1b | 1c | 1c |
| Second position (II) | 1b | 1c | 1a | 1b |
| Third position (III) | 1c | 1a | 1b | 1c |

We claim:

1. A toner image transfer type electrographic copying apparatus which comprises an endless image carrier, said endless image carrier being divided into a number of equal unit lengths, each unit length being capable of accepting an electrostatic latent image from a sheet to be copied, the total circumferential length of said endless image carrier being m times as long as a unit length, m being an integer equal to or greater than 3, at least two support rollers positioned within said endless image carrier, drive means capable of rotating at least one of said support rollers in order to move said endless image carrier in a predetermined direction, image-forming means for forming an electrostatic latent image from a sheet to be copied on the outer surface of said endless image carrier along a unit length thereof, developing means located adjacent the outer surface of said endless image carrier at a point in the forward direction of movement of said endless image carrier with respect to said image-forming means for developing an electrostatic latent image thereon into a toner image, transferring means located adjacent the outer surface of said endless image carrier at a point in the forward direction of movement of said endless image carrier with respect to said developing means for transferring a developed electrostatic latent image from said endless image carrier to a transfer member, toner-removing means located adjacent the outer surface of said endless image carrier at a point between the image-forming means and the transferring means for removing residual toner in the outer surface of said endless image carrier, control means for controlling the operation of said drive means such that it will rotate the support roller to which it is connected in a fashion that said endless image carrier will be rotated in said predetermined direction a unit drive distance for each copying operation, a unit drive distance being n times as long as a unit length, n being an integer smaller than m, greater than 1 and a number which has no common factor with m, and said transferring means being positioned along said endless image carrier a distance from said image-forming means which is less than said unit drive distance.

2. A toner image transfer type electrographic copying apparatus according to claim 1 wherein said toner-removing means is positioned at a point between the image-forming means and the developing means.

3. A toner image transfer type electrographic copying apparatus according to claim 1 wherein said toner-removing means includes a blade member pressed at one end thereof into contact with the outer surface of said endless image carrier.

4. A toner image transfer type electrographic copying apparatus according to claim 1 wherein said toner-removing means comprises a magnetic brush device having, in combination, a toner-removing function and an image-developing function.

5. A toner image transfer type electrographic copying apparatus according to claim 1 wherein said multiplication factor m of the overall circumferential length of said endless image carrier with respect to said unit length is an odd number and said multiplication factor n of said unit drive distance with respect to said unit length is 2.

6. A toner image transfer type electrographic copying apparatus according to claim 5 wherein m is 3.

7. A toner image transfer type electrographic copying apparatus according to claim 1 wherein said endless image carrier comprises an endless electrophotosensitive belt.

8. A toner image transfer type electrographic copying apparatus according to claim 7 wherein said image-forming means includes a full-frame exposure device and the outer surface of the electrophotosensitive belt on which the electrostatic latent image is formed is flat.

9. A toner image transfer type electrographic copying apparatus according to claim 1 said apparatus further including a second means of controlling the drive means for rotating the image carrier by an integral number of times as long as said unit length after copying the original image.

10. A toner image transfer type electrographic copying apparatus according to claim 1 said apparatus further including a second means of controlling the drive means for rotating the image carrier by an integral number of times as long as said unit length before copying the original image when intervals of copying extend for more than a specified period of time.

* * * * *